United States Patent [19]

Wood, Jr. et al.

[11] Patent Number: 5,027,493

[45] Date of Patent: Jul. 2, 1991

[54] TOILET TANK COVER AND METHOD OF INSTALLATION

[75] Inventors: Richard W. Wood, Jr., Villa Park, Calif.; Don R. Harris, deceased, late of Upland, Calif., by Barbara L. Wood, executrix

[73] Assignee: Gaylan Industries, Inc., Placentia, Calif.

[21] Appl. No.: 481,811

[22] Filed: Feb. 20, 1990

Related U.S. Application Data

[63] Continuation of Ser. No. 220,378, Jul. 11, 1988, abandoned, which is a continuation of Ser. No. 76,999, Jul. 22, 1987, abandoned, which is a continuation of Ser. No. 945,230, Dec. 23, 1986, abandoned, which is a continuation of Ser. No. 859,844, Apr. 30, 1986, abandoned, which is a continuation of Ser. No. 616,775, May 31, 1984, abandoned, which is a continuation of Ser. No. 314,460, Oct. 23, 1981, abandoned, which is a continuation-in-part of Ser. No. 126,839, Mar. 3, 1980, abandoned.

[51] Int. Cl.[5] ..... B21K 21/00

[52] U.S. Cl. ..... 29/401.1; 4/353; 4/DIG. 18

[58] Field of Search ..... 4/353, 661, 252 A, 412, 4/416, DIG. 9, DIG. 18; 29/401.1, 455.1, 466

[56] References Cited

U.S. PATENT DOCUMENTS

| | | | |
|---|---|---|---|
| 550,207 | 11/1895 | Traeger | 248/220.1 X |
| 814,811 | 3/1906 | Speed | 248/220.1 X |
| 849,708 | 4/1907 | Willms | 4/400 |
| 850,989 | 4/1907 | Willms | 4/416 X |
| 908,825 | 1/1909 | Willms | 4/363 X |
| 948,657 | 2/1910 | Bailey | 4/353 |
| 969,442 | 4/1910 | Bailey | 4/353 |
| 1,032,317 | 7/1912 | Zwermann | 4/353 |
| 1,380,518 | 6/1921 | Bellig | 248/220.1 X |
| 1,430,571 | 10/1922 | Leslie | 4/353 |
| 1,601,210 | 9/1926 | Haas | 4/412 X |
| 1,605,939 | 11/1926 | Haas | 4/412 X |
| 2,145,601 | 1/1939 | Hopper | 4/412 |
| 2,340,545 | 2/1944 | Marsh | 248/220.1 X |
| 2,637,360 | 5/1953 | Doebler | 4/416 X |
| 2,651,052 | 9/1953 | Madson | 4/252 A |
| 2,679,651 | 6/1954 | Pokorny | 4/412 X |
| 2,797,816 | 7/1957 | Ross | 4/353 X |
| 2,920,853 | 1/1960 | Bufogle | 248/287 X |
| 3,001,748 | 9/1961 | Austin | 248/300 |
| 3,087,168 | 4/1963 | Huso | 4/213 |
| 3,166,112 | 1/1965 | Fisher | 4/661 |
| 3,462,901 | 8/1969 | Jamgochian | 52/308 X |
| 3,860,972 | 1/1975 | Costello | 4/353 X |
| 3,903,551 | 9/1975 | Johnson | 4/249 |
| 3,927,429 | 12/1975 | Pearson | 4/213 |
| 4,368,551 | 1/1983 | Cummings | 4/253 X |

*Primary Examiner*—Henry J. Recla
*Assistant Examiner*—Robert M. Fetsuga
*Attorney, Agent, or Firm*—Lyon & Lyon

[57] ABSTRACT

A toilet tank cover and method of installation, the cover including a frame to surround an existing toilet tank, brackets for mounting the frame onto the tank, and an actuator for flushing the toilet which replaces the existing flush handle. The frame preferably includes a removable lid to permit access to the interior of the tank. The actuator includes a chain which may be attached to the flush valve and which may be operated from outside of the frame. Preferably, a return spring is provided to return the chain to its normal position and allow the valve to close after the toilet is flushed.

3 Claims, 2 Drawing Sheets

TOILET TANK COVER AND METHOD OF INSTALLATION

CROSS REFERENCES

This is a continuation of co-pending application Ser. No. 220,378 filed on July 11, 1988, now abandoned which is a continuation of co-pending application Ser. No. 076,999 filed on July 22, 1987, now abandoned which is a continuation of co-pending application Ser. No. 945,230, filed on Dec. 23, 1986, now abandoned, which is a continuation of co-pending application Ser. No. 859,844 filed on April 30, 1986, now abandoned, which is a continuation of application Ser. No. 616,775, filed May 31, 1984, now abandoned which is a continuation of application Ser. No. 314,460, filed Oct. 23, 1981 now abandoned, which is a continuation-in-part of application Ser. No. 06/126,839, filed Mar. 3, 1980, now abandoned, the specification of which is incorporated herein by reference.

BACKGROUND OF THE INVENTION

The present invention relates to toilet tank covers, and more particularly to covers which may be decorative and pleasantly attractive while simultaneously permitting simple and efficient operation of the toilet.

To provide a more attractive appearance to a toilet it has previously been necessary to remove the entire existing toilet tank and install in its place a box or frame which includes a replacement toilet tank within it. Such devices had a crude flush mechanism and were relatively expensive because of the need to replace the entire tank with its associated internal elements. Also, such tanks often had difficulties with moisture sealing, and frequently the toilet seat did not remain standing when lifted because of an inexact correspondence to the dimensions of the original tank.

SUMMARY OF THE INVENTION

According to the present invention there is provided a toilet tank cover which fits easily over most conventional toilet tanks and which includes a simple, reliable pull chain flush mechanism which replaces the standard flush handle and which attaches to any style of flush valve. The cover preferably includes a removable lid to provide access to the interior of the tank and noise-reducing means such as polyethylene foam pads which also provide a moisture seal underneath the lid. The pull chain is preferably spring loaded to permit the toilet flush valve to return to its closed position in a normal manner when the chain is released. Brackets are provided for supporting the cover on the existing toilet tank, and are preferably located on the interior of the frame. When the brackets are properly located, the cover normally will not interfere with the usual operation of the toilet seat.

Accordingly, it is an object of the present invention to provide an improved toilet tank cover which may be mounted on an existing toilet tank in a manner adaptable to most such tanks.

It is another object of the present invention to provide a toilet tank cover which will not interfere with the normal operation of the toilet seat.

It is a further object of the present invention to provide a simple and reliable flush mechanism for association with a toilet tank cover which replaces the existing flush handle and which may be attached to any style of flush valve.

These and other and further objects of the present invention will become apparent from the following detailed description, taken in conjunction with the accompanying drawings.

DETAILED DESCRIPTION OF THE PREFERRED EMBODIMENT

Figure 1:
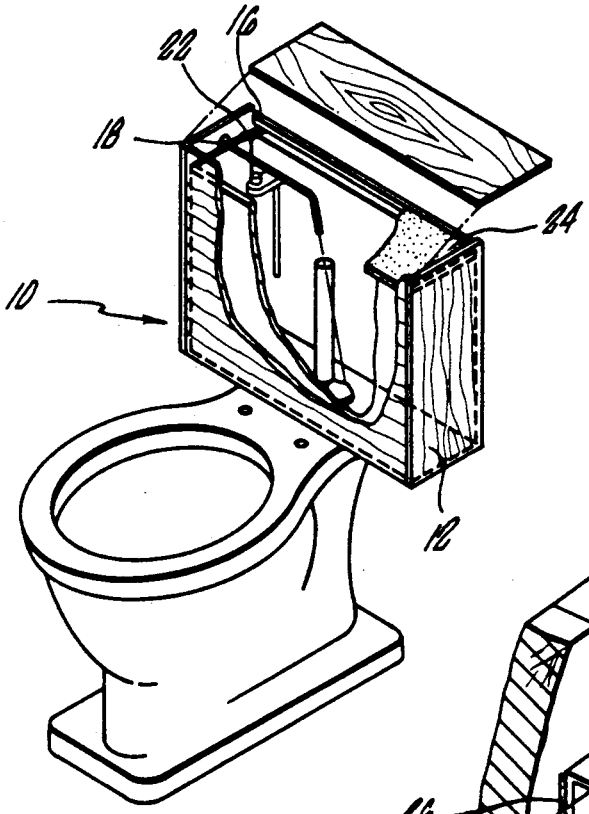
FIG. 1 is a perspective and partially broken view of a toilet tank cover according to the present invention, shown mounted on an existing toilet tank.

Referring first to FIG. 1, there is illustrated a toilet tank cover 10 according to the present invention, mounted upon an existing toilet tank. The cover 10 includes a frame 12 having two sides and a front, and a removable lid 14. For lower cost and lighter weight, as well as ease of installation, the frame 12 preferably has no back, but rather simply a backstrap or brace 16 extending between its two sides. Extending through one of the sides of the frame 12 is a downwardly curved chain housing 18 such as a brass tube, through which passes a chain 20 which may be connected to the existing flush valve in a manner to be described in greater detail hereinafter. A pair of brackets 22, only one of which is visible in FIG. 1, are mountable upon the interior surfaces of the sides of the frame, and rest upon the upper edge of the existing toilet tank. A pair of polyethylene foam seals 24 or the like, only one of which is shown in FIG. 1 and is broken for ease of illustration, may be placed within the frame 12 just underneath the lid 14 to provide a moisture seal and to help reduce the noise of the toilet flush mechanism. The seals may be provided in a standard size and trimmed if necessary to fit any particular installation requirements.

Figure 2:
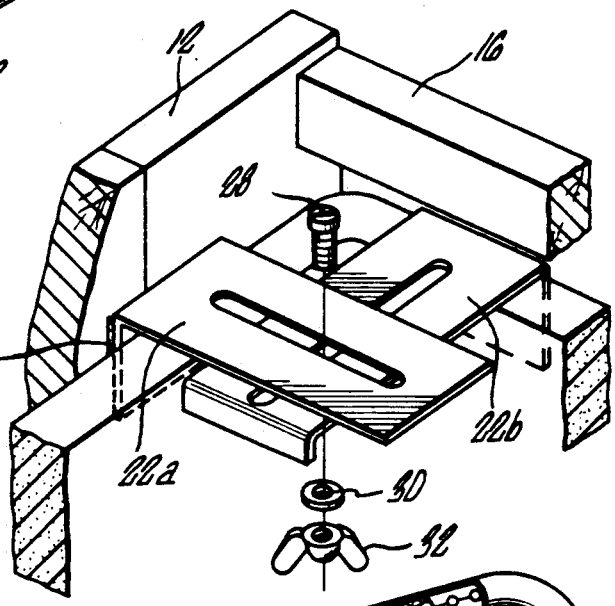
FIG. 2 is a detailed perspective view of the manner of mounting the brackets to the inside of the toilet tank cover and the manner of supporting the cover on an existing toilet tank.

Referring next to FIG. 2, there is illustrated a detailed view of the manner of attachment of the first preferred embodiment of brackets 22 to the frame 12 for supporting the frame 12 on the existing toilet tank. The brackets 22 preferably comprise a side-mounted L-shaped bracket **22*a* and a rear-facing L-shaped bracket 22*b*, and a similar set of brackets is provided on the opposite side of the frame 12. The side-mounted bracket 22*a* is preferably attached to the interior of the side of the frame 12 in the desired location by a piece of double-sided foam tape 26. Alternative means of attachment, of course, could be utilized. The placement of the side-mounted bracket 22*a* on the frame 12** will be determined by the size of the particular tank onto which the cover is to be mounted so that the tank is covered completely and the tank does not interfere with the pull chain apparatus.

The rear-facing bracket **22*b* may be attached to the side-mounted bracket 22*a* by fastening means such as a bolt 28 passing through coincident apertures in the brackets 22*a* and 22*b* and secured by a lock washer 30** and a wing nut 32. The brackets 22*a* and 22*b* should be adjusted with respect to each other so that when the wing nut 32 is tightened onto the bolt 28, the interior surface of the front of the frame 12 is pressed against the front of the existing toilet tank and the rear-facing bracket 22*b* fits snugly over the rear of the upper edge of the tank. Such adjustment, coupled with a front portion of the frame 12 which is relatively thin, will insure that in most cases the toilet seat will remain in an upright position when lifted. A latch means (not shown) may be provided as an option to hold the seat upright when necessary.

Figure 4:
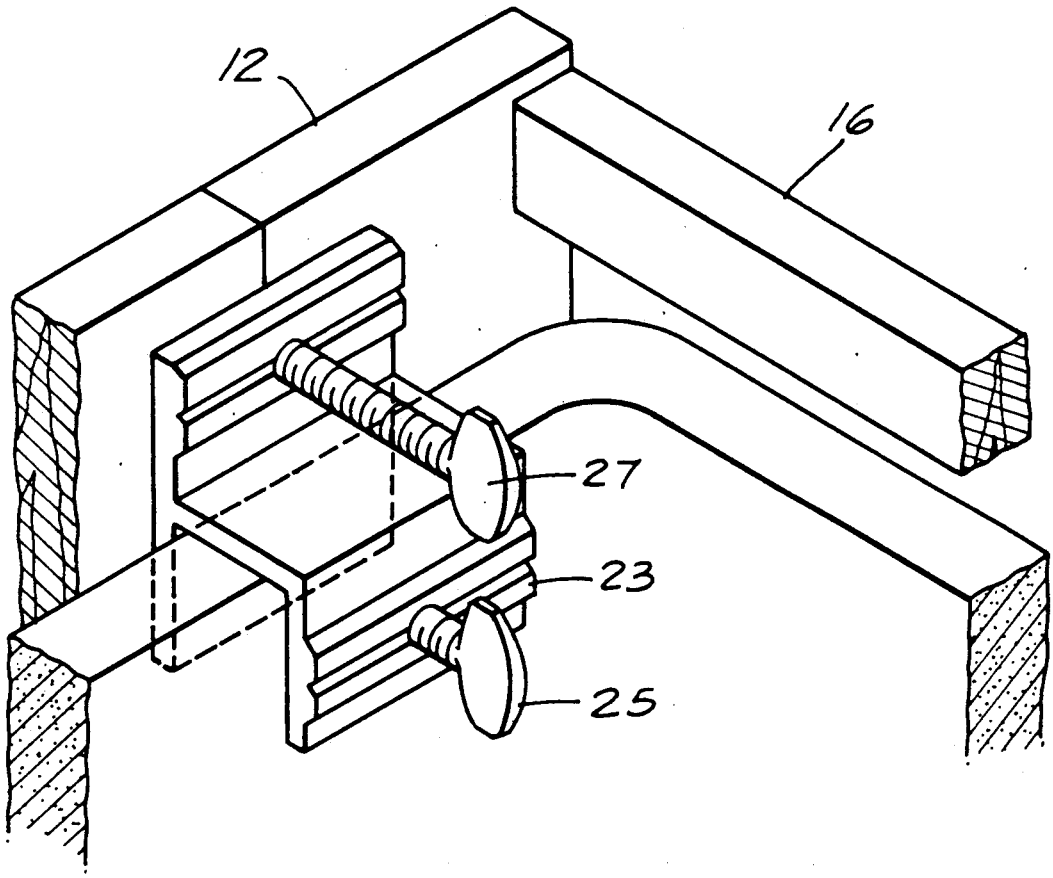
FIG. 4 is a perspective view of a second preferred bracket embodiment showing the manner of mounting the bracket to the cover and existing tank.

Referring now to FIG. 4, there is shown a second preferred embodiment of a bracket, 23, for supporting the frame 12 on an existing toilet tank. The bracket 23 has an h-shape and further has two threaded holes, an upper threaded hole and a lower threaded hole. A pair of such brackets 23, only one of which is visible in FIG. 4, is mounted on the top edge of opposing sides of an existing tank, one bracket on each side. The base of the h-shape fits over the top edge of a tank and is secured thereto by a threaded bolt 25, which is screw-threaded into the lower hole. The threaded bolt 25 has a blunt, substantially flat end which presses against an inner surface of a tank to hold the bracket 23 securely in place. A second threaded bolt 27 is screw-threaded into the upper threaded hole, in the upper arm of the bracket 23. The bolt 27 has a pointed end which pierces the wood, or other material of the frame 12, allowing the bolt 27 to be screw-threaded into the frame 12 to thereby secure the cover to an existing toilet tank.

Figure 3:
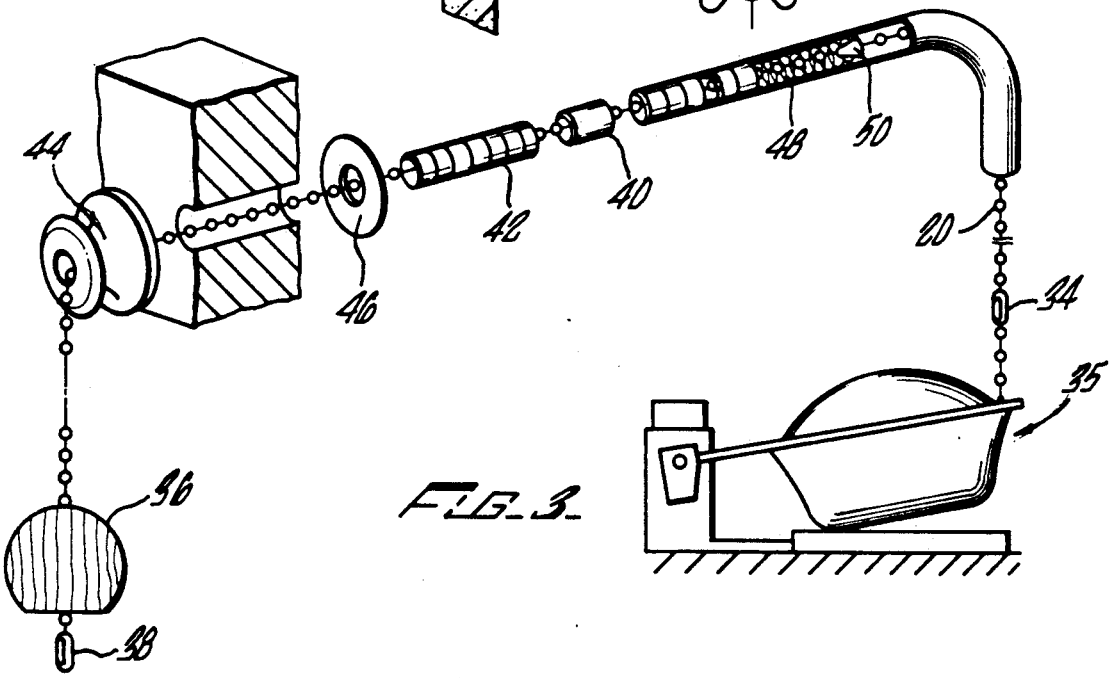
FIG. 3 is an exploded view of a flush mechanism according to the present invention, showing the manner of attachment thereof to the existing flush valve and to the toilet tank cover.

FIG. 3 is an exploded view of the flush mechanism. The mechanism extends through a side of the frame 12, as previously indicated, and includes the chain housing 18 through which passes the chain 20. The chain 20 may be attached to the flush valve 35 by cutting the existing chain connected to the valve 35 or by removing any rod or other connector attached to the valve and attaching the chain 20 thereto by a chain connector 34 if a ball chain is connected to the valve 35 or by equivalent means such as a clip or the like if an eyelet or open chain is connected to the valve. In this manner the flush mechanism of the present invention may be attached to a flush valve of any commercially available style. At the other end of the chain 20 is attached a chain pull 36 which may be securely engaged with the chain 20 such as by a chain connector 38 attached to the end of the chain 20.

The flush mechanism is mounted on the frame 12 by threading a connector 40 onto the chain housing 18 and onto a close nipple 42 which extends through the frame 12 and is threaded at its other end onto a decorative nut 44. A washer 46 may be provided which is secured against the inside of the frame 12 by the connector 40.

Mounted within the chain housing 18 and surrounding the chain 20 passing therethrough is a coil spring 48. A chain retainer 50 is attached to the chain 20 adjacent the end of the spring 48 which is nearest the flush valve 35. When the chain pull 36 is pulled, thus activating the valve 35, the retainer 50 causes compression of the spring 48. When the chain pull 36 is released, the spring 48 expands to its normal position, exerting pressure on the retainer 50 and thus the chain 20 and allowing the valve to close normally.

To mount the cover on an existing toilet tank, the tank is first emptied of water and then the existing lid and flush handle, together with the inside lever attached to the flush handle, are removed. The cover is then placed over the existing tank and may be held in place temporarily by pressing the cover against a piece of double-sided tape mounted on the front of the tank. The mounting brackets are then assembled and the double-sided tape is pressed onto the side-mounted brackets, which are then attached to the interior of the sides of the frame near the rear edges thereof. The rear-facing brackets are then adjusted to insure a snug fit against the upper edge of the tank and the wing nuts are tightened to secure the brackets together. Preferably the rear-facing brackets include a downwardly turned flange which may be adjustably abutted against the interior of the tank to prevent lateral movement of the cover.

The chain is then attached to the flush valve as previously described in connection with FIG. 3, and the toilet should operate in a normal manner when the chain is pulled. The polyethylene foam seals are then installed snugly above the brackets, making a slit in one if necessary to accommodate the chain housing. The lid is then placed onto the frame and assembly of the cover is completed.

The chain housing and chain, together with the associated hardware, are typically of brass, although the portion of the chain that is immersed in water may be nickel-plated to help prevent oxidation or corrosion. The spring may be of zinc plate. All threads should be one-eighth ($\frac{1}{8}$th) IPS, and the chain housing typically has an outside diameter of three-eighths ($\frac{3}{8}$th) inches. For attractiveness, the cover may be made of a hardwood such as oak, with a lacquer or similar finish, or may be molded of plastic in a variety of colors.

It will be apparent from the foregoing description that there has been provided by the present invention an improved toilet tank cover which is adaptable to a variety of sizes of toilet tanks and which includes a flush mechanism which is simple to use and reliable in operation. While a presently preferred embodiment of the present invention has been illustrated and described, many modifications and variations thereof will be apparent to those skilled in the art given the teachings herein, and it is intended that all such modifications and variations be encompassed within the scope of the appended claims.

What is claimed is:

1. A method of installing a decorative toilet tank cover onto a toilet tank having an existing lid and an existing actuation lever, comprising the steps of:

removing the existing lid;

removing the existing actuation lever and linkage;

assembling a toilet tank cover frame having only a front side and two lateral sides by attaching the front side perpendicularly to the two lateral sides and attaching a support brace to a rear upper corner of the two lateral sides parallel to the front side;

mounting the tank cover frame at each lateral side of the toilet tank by a suitable mounting means to position the tank cover frame to leave a gap between the toilet tank and the sides of the tank cover frame;

positioning the support brace adjacent to a top rear edge of the toilet tank such that the lateral sides and the front side of the tank cover upwardly extend past the rim of the toilet tank;

attaching an actuator means to the flush valve in the toilet tank and extending the actuator means over the upper rim of the toilet tank and through an aperture in a side of the toilet tank cover frame;

installing a moisture sealing means over the top opening of the toilet tank; and positioning a removable lid on the top of the toilet tank.

2. A method of installing a decorative toilet tank cover according to claim 1 wherein the step of mounting the tank cover includes:

locating a first L-shaped bracket with one leg over a rear edge of the tank so as to be oriented vertically and adjacent a rear side of the tank with the other leg extending horizontally over the tank, wherein the horizontal leg has a slot along its longitudinal axis, locating a second L-shaped bracket with one leg aligned vertically over the side edge of the tank with the other leg extending horizontally over the tank and having a slot along its longitudinal axis, positioning the first and second L-shaped brackets with one bracket on top of the other such that the longitudinal slots intersect generally perpendicularly;

securing the first and second brackets together by a bolting means positioned through the slots; and attaching the vertically aligned leg of the second angle bracket to an interior surface of a side edge of the toilet tank cover.

3. A method of installing a decorative toilet tank cover according to claim 1 wherein the step of mounting the tank cover includes:

locating an h-shaped bracket so as to straddle a side edge of the tank with its stem upright and parallel to the side edge of the tank and its outward leg extending over the side and into the tank, securing the h-shaped bracket to the tank by screwing a bolt through a threaded hole in the bracket leg and pressing the bolt end against an inner surface of the tank, and securing the tank cover to the stem of the h-shaped bracket.

* * * * *